US005138830A

United States Patent [19]

Stahlecker

[11] Patent Number: 5,138,830

[45] Date of Patent: Aug. 18, 1992

[54] SPINNING MACHINE HAVING A PLURALITY OF DRAFTING UNITS

[75] Inventor: Fritz Stahlecker, Bad Überkingen, Fed. Rep. of Germany

[73] Assignee: Hans Stahlecker, Fed. Rep. of Germany; a part interest

[21] Appl. No.: 768,110

[22] Filed: Sep. 30, 1991

Related U.S. Application Data

[63] Continuation of Ser. No. 544,894, Jun. 28, 1990, abandoned.

[30] Foreign Application Priority Data

Jul. 4, 1989 [DE] Fed. Rep. of Germany ..... 3921931

[51] Int. Cl.[5] ..... D01H 5/86

[52] U.S. Cl. ..... 57/315; 57/300; 19/293

[58] Field of Search ..... 19/258, 294, 293; 57/300-301, 315, 352

[56] References Cited

U.S. PATENT DOCUMENTS

| | | | |
|---|---|---|---|
| 2,589,797 | 3/1952 | Getchell | 19/293 X |
| 2,934,797 | 5/1960 | Whitehurst | 57/304 X |
| 3,553,792 | 3/1967 | Anderson | 19/258 |
| 4,498,216 | 2/1985 | Suzuki et al. | 19/293 X |
| 4,525,897 | 7/1985 | Schulz et al. | 19/293 X |
| 4,538,329 | 9/1985 | Sakai et al. | 19/258 X |
| 4,768,262 | 8/1988 | Gunter | 19/258 |

FOREIGN PATENT DOCUMENTS

| | | | |
|---|---|---|---|
| 3844072 | 7/1990 | Fed. Rep. of Germany | 19/258 |
| 0791807 | 12/1980 | U.S.S.R. | 19/258 |

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

In a spinning machine having a plurality of drafting units which each comprise several bottom rollers constructed as roller sections, it is provided that the sliver-carrying area of the bottom rollers is separated from the area receiving the clutch element and the driving wheels by means of a partition, the partitions of two adjacent drafting units being connected with one another.

14 Claims, 3 Drawing Sheets

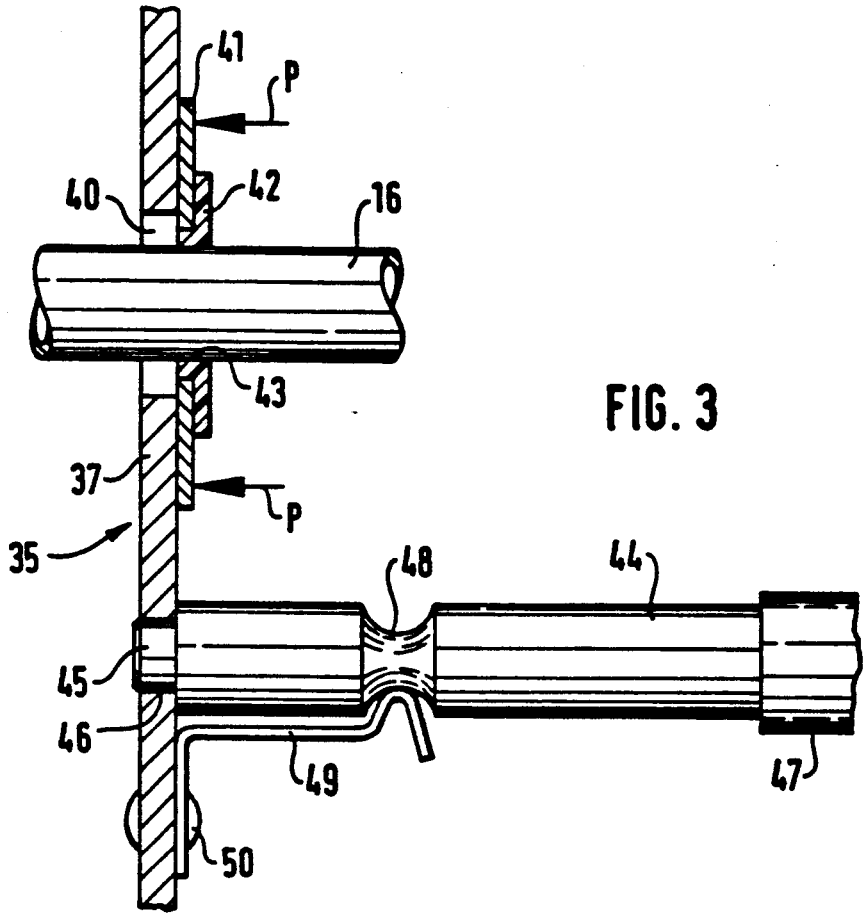
FIG. 3
FIG. 4
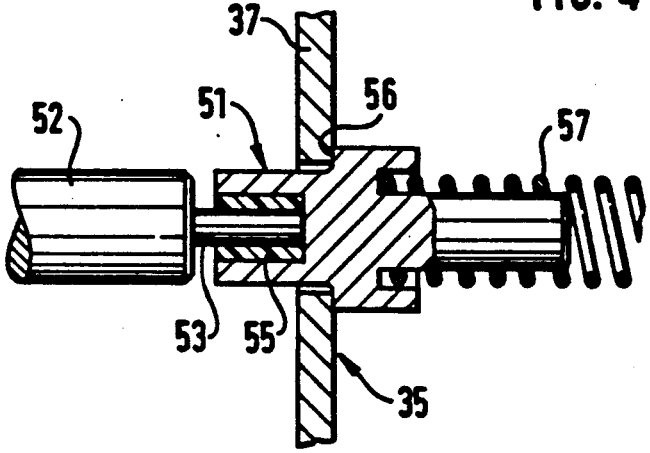

SPINNING MACHINE HAVING A PLURALITY OF DRAFTING UNITS

This is a continuation of application Ser. No. 07/544,894 filed on Jun. 28, 1990 and now abandoned.

BACKGROUND AND SUMMARY OF THE INVENTION

The invention relates to a spinning machine having a plurality of drafting units, each comprising several bottom rollers which are constructed as roller sections and which, by way of shiftable clutch elements and driving wheels, are connected with a drive.

A spinning machine of the initially mentioned type is the object of an older German Patent Application P 38 44 072.5, corresponding to U.S. application Ser. No. 07/455,187, now U.S. Pat. No. 4,991,263 which is no prior publication. In this spinning machine, the fiber-carrying areas of the bottom rollers, in addition, are separated by means of a partition from the area receiving the clutch elements and the driving wheels.

It is an object of the invention to improve the shielding of the driving elements with respect to the fiber-carrying areas in a spinning machine of the above-mentioned type.

This object is achieved in that the fiber-carrying area of the bottom rollers is separated from the area receiving the clutch elements and the driving wheels by means of a partition, in which case the partitions of two adjacent drafting units are connected with one another.

In this construction, the partitions of adjacent drafting units are combined so that they form a structural unit that can be mounted as such.

In an advantageous development of the invention, it is provided that two partitions respectively are connected with one another by means of a transverse web to form a U-shaped profile. This U-shaped profile forms a tub-shaped component which permits a clear separation between the driving areas and the sliver-carrying areas.

In a further development of the invention, it is provided that the sliver-carrying areas of the bottom rollers of the drafting units which follow one another in the longitudinal direction of the machine alternately face one another and face away from one another, and in that the partitions of the respective fiber-carrying areas which face one another are connected with one another.

Other objects, advantages and novel features of the present invention will become apparent from the following detailed description of the invention when considered in conjunction with the accompanying drawings.

BRIEF DESCRIPTION OF THE DRAWINGS

FIG. 3 is an enlarged partial sectional view of FIG. 1 with sealing elements for the passage of a bottom roller and with a holding device for the partitions; and FIG. 4 is another sectional view of a partition in the area of a bearing of a cleaning device held by the partition.

DETAILED DESCRIPTION OF THE DRAWINGS

Figure 1:
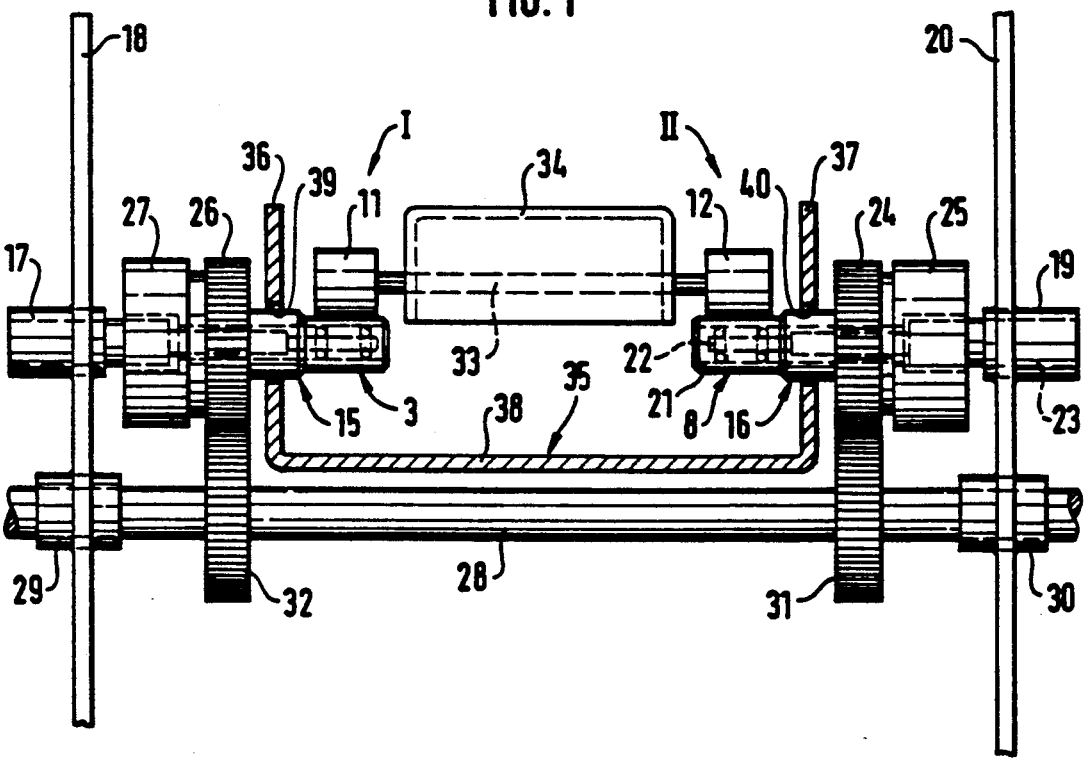
FIG. 1 is a cross-sectional schematic view of two adjacent drafting units of a spinning machine with partitions which are combined to form a U-shaped profile, constructed according to a preferred embodiment of the invention.
Figure 2:
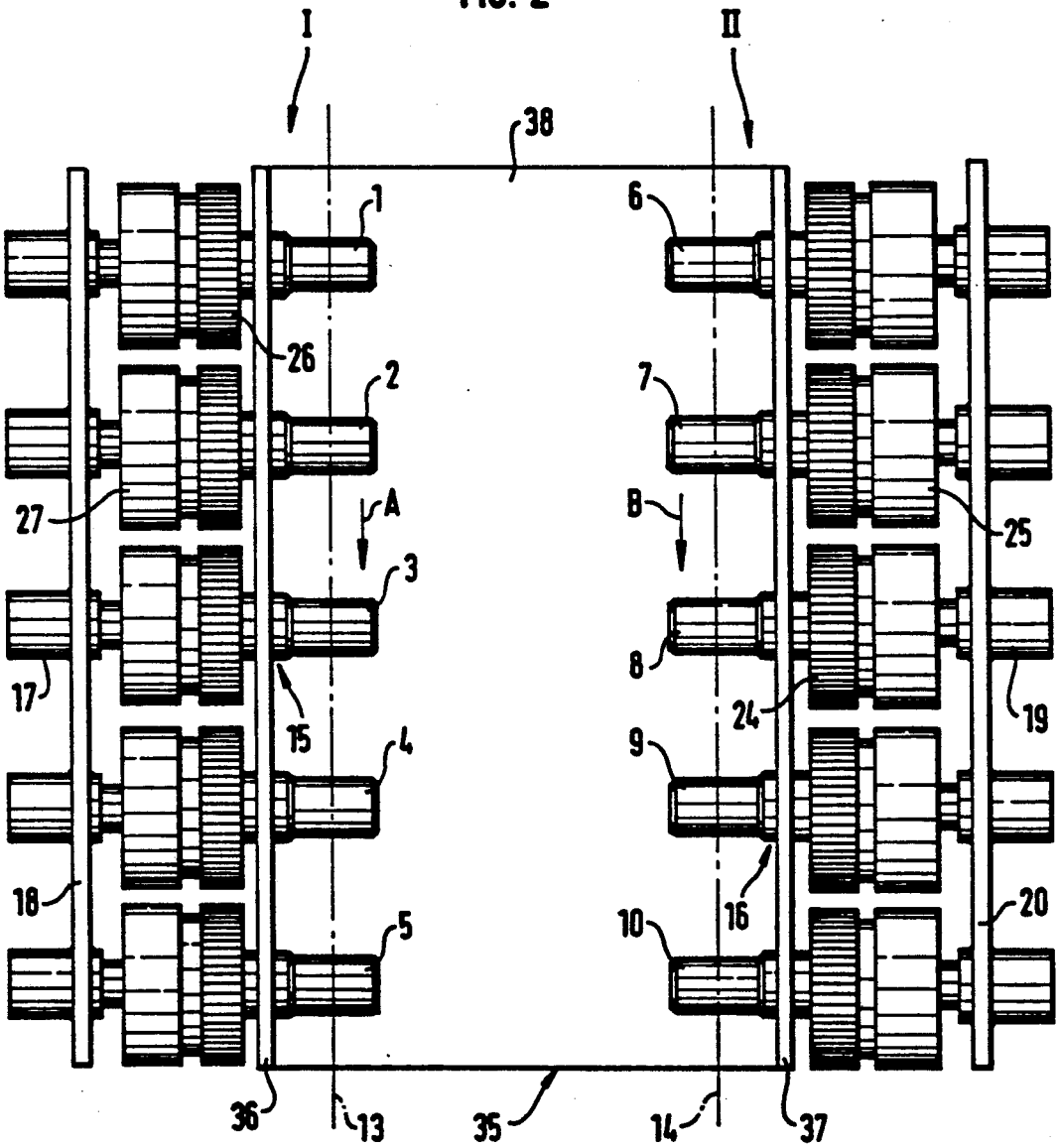
FIG. 2 is a view of the drafting units according to FIG. 1, a loading arm for top rollers having been left out in comparison to FIG. 1.

FIGS. 1 and 2 show the drafting units (I and II) of two adjacent spinning points of a spinning machine. A sliver 13, 14, which is outlined by dash-dotted lines, is guided through each of the respective drafting units (I and II) and is drafted and moves in the direction of the arrows (A and B). Drafting unit (I) comprises bottom rollers 1, 2, 3, 4, 5, and drafting unit (II) comprises bottom rollers 6, 7, 8, 9, 10. These bottom rollers 1 to 10 cooperate with top rollers 11, 12 which are held by a common loading arm (34) (FIG. 1). These pressure rollers 11, 12 are constructed as so-called pressure roller pairs which have a common shaft 33 housed in the loading arm 34. In addition, the drafting units (I, II) comprise apron guides which are not shown.

The bottom rollers 1 to 10 are constructed as roller sections 15, 16 which are held in bearing seats 17, 19 of roller stands 18, 20. These roller sections 15, 16 each extend in the longitudinal direction of the machine, the roller sections 15, 16 of adjacent drafting units being aligned coaxially with respect to one another.

The roller sections 15, 16 of the bottom rollers 1 to 10 each have a stationary shaft 22 which is held in the roller stands 18, 20 and on which travelling sleeves 21 are disposed. The travelling sleeves 21, in each case, together with top rollers 11, 12, form a nip line. The sleeves 21 are disposed on the shafts 22 which, with their end 23, are clamped into the bearing seats 17, 18 of the roller stands 18, 20. By means of a shiftable clutch 25, 27, the sleeves 21 can be coupled with a driving wheel 24, 26. Driving wheels 24, 26 engage in driving wheels 31, 32 which are non-rotatably arranged on a driven driving shaft 28 extending through in the longitudinal direction of the machine. The shaft 28 is disposed in seats 29, 30 of the roller stands 18, 20. By means of the clutches 25, 27, it is possible, while the driving shaft 28 continues to move, to stop the bottom rollers (1 to 5 or 6 to 10) of an individual drafting unit (I, II) despite a continuously running driving shaft 28.

The bottom rollers (1 to 5 and 6 to 10) constructed as roller sections 15, 16 therefore each have a sliver-carrying area, specifically the area in which they form nip lines with the top rollers 11, 12, and a driving area in which the driving wheels 24, 26 and the pertaining clutches 25, 27 are arranged. In this case, the bottom rollers (1 to 5 and 6 to 10) are arranged in such a manner that the sliver-carrying areas face one another. The pair of drafting units that follows next in the longitudinal direction of the machine is constructed corresponding to FIG. 1 and 2.

The sliver-carrying area of the drafting units (I and II) is separated from the driving area by one partition respectively 36, 37 which extends in the travel direction (A, B) of the slivers 13, 14. The two partitions 36, 37 are connected with one another by means of a transverse web 38 situated on the side of the bottom rollers (1 to 5 and 6 to 10) facing away from the top rollers 11, 12, so that the two partitions 36, 37, together with the transverse web 38, form an approximately U-shaped profile 35 which forms a tub-shaped structure in the fiber-carrying area. The partitions 36 37 are provided with passage openings 40 (FIG. 3), through which the shaft sections 15, 16 are guided. In this case, a so-called floating seal is provided in each case A sealing disk 41 (FIG. 3) is pressed against the partition 37 by means of spring force (P) and carries a sealing insert 42 which consists of plastic material and which is adapted to the shaft section 16 with little play. The sealing disk 41 with the insert 42 is therefore centered on the shaft section 16.

The U-shaped profile 35 is held and centered by means of several stud bolts 44. These stud bolts 44, in each case, by means of a projection 45 with a reduced diameter constructed as a fitting, engage in a corresponding fitted bore 46 of the partitions 36, 37. The stud bolts 44 themselves are held at a part 47 of the machine frame. In this case, it is naturally also possible to mount the stud bolts 44 at the roller stands 18, 20. An axial securing takes place by means of a leaf spring 49 which is mounted at the partitions 36, 37 by means of rivets 50 or the like and which, by means of a bend engages in a recess 48 of the stud bolts 44.

Corresponding to the embodiments according to FIG. 4, the U-shaped profile 35, of which only a section of the partition 37 is shown in FIG. 4, is also used as a holding device for a cleaning device. This type of a cleaning device may be provided for the bottom rollers 1 to 10 as well as for the top rollers 11, 12. Such a cleaning device, as a rule, comprises two deflecting rollers, of which one deflecting roller 52 is shown and which carry a rag which moves against the circumferential surfaces of the bottom rollers 1 to 10 or of the top rollers 11, 12. The deflection roller 52, by means of a pin 53, is guided in a sliding bearing 55 which is a component of a bearing insert 51. This bearing insert 51 penetrates a bore of the partition 37 at which it is supported by means of an annular collar 56. The bearing insert 51, by means of a spring 57, is loaded in the direction toward the partition 37. By pulling back the bearing insert 51 against the effect of the spring 57, the deflection roller 52 can easily be demounted.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A drafting unit arrangement for a spinning machine, comprising:

first and second drafting units disposed adjacent one another for drafting a pair of slivers, said first drafting unit including a plurality of first bottom rollers and a corresponding plurality of first top rollers disposed to cooperate respectively with one another to define a sliver drafting path between the first top rollers and first bottom rollers;

said second drafting unit including a plurality of second bottom rollers and a corresponding plurality of second top rollers disposed to cooperate respectively with one another to define a sliver drafting path between the second top rollers and second bottom rollers, at least a plurality of each of said first and second bottom rollers being carried on respective stub shafts which are selectively drivably engageable with a drive by way of respective shiftable clutch elements and driving wheels, wherein said first and second top rollers are carried by a common loading arm to form pressure roller twins, wherein free ends of said stub shafts and bottom rollers at the first drafting unit face free ends of stub shafts and bottom rollers of the second drafting unit with the clutch elements and driving wheels disposed at respective laterally outer ends of the stub shafts opposite the respective free ends of said stub shafts and bottom rollers, and a partition unit for separating bottom roller fiber carrying areas of the first and second drafting units from the clutch elements and driving wheels, said partition unit including a first partition wall interposed between the first bottom rollers and the clutch elements and driving wheels of the first drafting unit and a second partition wall extending between the second bottom rollers and the clutch elements and driving wheels of the second drafting unit, said first and second partition walls being connected together by a connection partition to form a common partition unit with the first and second partition walls facing one another and surrounding the first and second bottom rollers of both the first and second drafting units with their respective clutch elements and driving wheels disposed laterally outside of the respective first and second partition walls, whereby the common partition unit serves to protect the fiber carrying areas of the first and second drafting units from the respective clutch elements and driving wheels driving the sets of first and second bottom rollers of the adjacent first and second drafting units, without limiting access to the clutch elements and driving wheels.

2. A drafting unit arrangement according to claim 1, wherein said connection partition is a transverse web which connects the first and second partition walls to form a U-shape profile, said web extending below the bottom rollers of both the first and second drafting units.

3. A drafting unit arrangement according to claim 2, wherein the bottom rollers are carried by respective roller stands, and wherein the first and second partition walls are mounted at respective roller stands carrying the bottom rollers by means of a holding device.

4. A drafting unit arrangement according to claim 2, wherein the first and second partition walls are provided with passage openings for the bottom rollers which are sealed off by means of floating sealing disks.

5. A drafting unit arrangement according to claim 2, wherein the first and second partition walls and web are formed together as a one-piece unit which extends along the sliver carrying length of the respective first and second drafting units.

6. A drafting unit arrangement according to claim 2, comprising a plurality of pairs of said first and second drafting units arranged adjacent one another along a longitudinal side of a spinning machine for supplying drafted sliver to respective spinning units of the spinning machine, wherein the bottom rollers of the drafting units which follow one another in the longitudinal direction of the machine alternately face with their free ends in opposite directions, and wherein the first and second partition walls of the respective fiber-carrying areas which face one another are connected with one another by said connection partition.

7. A drafting unit arrangement according to claim 6, wherein the bottom rollers are carried by respective roller stands, and wherein the first and second partition walls are mounted at respective roller stands carrying the bottom rollers by means of a holding device.

8. A drafting unit arrangement according to claim 7, wherein the first and second partition walls are provided with passage openings for the bottom rollers which are sealed off by means of floating sealing disks.

9. A drafting unit arrangement according to claim 6, wherein the first and second partition walls are provided with passage openings for the bottom rollers which are sealed off by means of floating sealing disks.

10. A drafting unit arrangement according to claim 1, wherein the bottom rollers are carried by respective roller stands, and wherein the first and second partition walls are mounted at respective roller stands carrying the bottom rollers by means of a holding device.

11. A drafting unit arrangement according to claim 10, wherein the first and second partition walls are provided with passage openings for the bottom rollers which are sealed off by means of floating sealing disks.

12. A drafting unit arrangement according to claim 1, wherein the first and second partition walls are provided with passage openings for the bottom rollers which are sealed off by means of floating sealing disks.

13. A drafting unit arrangement according to claim 1, wherein the first and second partition walls include support means for at least one auxiliary device.

14. A drafting unit arrangement according to claim 1, comprising a plurality of pairs of said first and second drafting units arranged adjacent one another along a longitudinal side of a spinning machine for supplying drafted sliver to respective spinning units of the spinning machine, wherein the bottom rollers of the drafting units which follow one another in the longitudinal direction of the machine alternately face with their free ends in opposite directions, and wherein the first and second partition walls of the respective fiber-carrying areas which face one another are connected with one another by said connection partition.

* * * * *